US007977557B2

(12) United States Patent
Broderick

(10) Patent No.: US 7,977,557 B2
(45) Date of Patent: Jul. 12, 2011

(54) MUSICAL INSTRUMENT PLECTRUM CLIP

(76) Inventor: Christopher Alan Broderick, Lake Balboa, CA (US)

( * ) Notice: Subject to any disclaimer, the term of this patent is extended or adjusted under 35 U.S.C. 154(b) by 0 days.

(21) Appl. No.: 12/571,767

(22) Filed: Oct. 1, 2009

(65) Prior Publication Data

US 2011/0079131 A1 Apr. 7, 2011

(51) Int. Cl.
*G10D 3/16* (2006.01)

(52) U.S. Cl. ..... 84/322; 84/320

(58) Field of Classification Search ..... 84/322, 84/320

See application file for complete search history.

(56) References Cited

U.S. PATENT DOCUMENTS

| | | | | | |
|---|---|---|---|---|---|
| 413,579 | A | * | 10/1889 | Stewart | 84/322 |
| 557,293 | A | * | 3/1896 | Wahl | 84/322 |
| 1,557,476 | A | * | 10/1925 | Kimball et al. | 84/322 |
| 1,787,136 | A | * | 12/1930 | Beauchamp | 84/322 |
| 2,045,571 | A | * | 6/1936 | Dopyera | 84/322 |
| 2,221,234 | A | * | 11/1940 | Frasier | 84/322 |
| 2,776,592 | A | * | 1/1957 | Di Preta | 84/322 |
| 3,442,169 | A | * | 5/1969 | Bowers | 84/322 |
| 3,648,558 | A | * | 3/1972 | Chenette | 84/322 |
| 3,650,172 | A | * | 3/1972 | Osborne | 84/322 |
| 3,789,720 | A | * | 2/1974 | McIntyre | 84/322 |
| 4,020,732 | A | * | 5/1977 | Kelly | 84/322 |
| 4,102,234 | A | * | 7/1978 | Brundage | 84/322 |
| 4,270,433 | A | * | 6/1981 | Adamec | 84/322 |
| D291,809 | S | * | 9/1987 | Jasper | D17/20 |
| 4,867,032 | A | * | 9/1989 | Lukehart | 84/322 |
| 6,054,643 | A | * | 4/2000 | Chance et al. | 84/322 |
| 6,797,871 | B2 | * | 9/2004 | Atkin | 84/322 |
| 6,949,700 | B1 | * | 9/2005 | Kelly | 84/322 |
| 7,157,635 | B2 | * | 1/2007 | Sogabe | 84/320 |
| 7,312,386 | B2 | * | 12/2007 | Sielaff et al. | 84/320 |
| 7,799,979 | B2 | * | 9/2010 | Swartz | 84/322 |
| 7,812,234 | B2 | * | 10/2010 | Dybas | 84/322 |
| 2003/0047058 | A1 | * | 3/2003 | Pearson-Bey | 84/322 |
| 2004/0237754 | A1 | * | 12/2004 | Sogabe | 84/322 |
| 2006/0086231 | A1 | * | 4/2006 | Sielaff | 84/322 |
| 2009/0139384 | A1 | * | 6/2009 | Bramucci | 84/322 |

FOREIGN PATENT DOCUMENTS

| | | | | |
|---|---|---|---|---|
| DE | 20114315 | U1 | * | 11/2001 |
| DE | 10231272 | A1 | * | 1/2004 |
| FR | 2584846 | A1 | * | 1/1987 |
| JP | 09134169 | A | * | 5/1997 |

* cited by examiner

*Primary Examiner* — Jeffrey Donels
*Assistant Examiner* — Robert W Horn

(57) ABSTRACT

The Pick clip increases ones ability to do multiple plucked instrument techniques without having to lose control of the pick. With the pick fixed to the thumb there is no effort wasted on holding the pick between the thumb and index finger, allowing the user to utilize the index finger and thumb independently to pluck, and tap the instrument along with using the instrument percussively.

5 Claims, 3 Drawing Sheets

MUSICAL INSTRUMENT PLECTRUM CLIP

CROSS-REFERENCE TO RELATED APPLICATIONS

Not applicable

STATEMENT REGARDING FEDERALLY SPONSORED RESEARCH OR DEVELOPMENT

Not applicable

NAMES OF THE PARTIES TO A JOINT RESEARCH AGREEMENT

Not applicable

BACKGROUND OF INVENTION

This invention relates to guitar thumb type-picks whereas the user can selectively replace various types and styles to and fixed apparatus applied to the thumb in order to maintain pick control. Control is determined by the ability to have the pick stay fixed to the thumb while the user is doing techniques that would compromise the hold of the pick allowing it to fall from ones grip.

SUMMARY OF THE INVENTION

The present invention relates to Clips that are made to fix any musical instrument pick to the thumb made out of but not limited to the various materials listed in the title.

The Plectrum Clip increases ones ability to do multiple plucked instrument techniques without having to lose control of the pick. With the pick fixed to the thumb there is no effort wasted on holding the pick between the thumb and index finger, allowing the user to utilize the index finger and thumb independently to pluck, and tap, the instrument along with using the instrument as a percussive instrument.

DETAILED DESCRIPTION OF THE INVENTION

Figure 1:
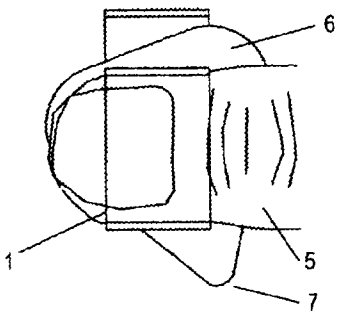
FIG. 1: Illustrates the bottom view of the completed assembly of the one piece formed design, where the thumb, pick and Plectrum Clip are in relationship to one another.
Figure 2:
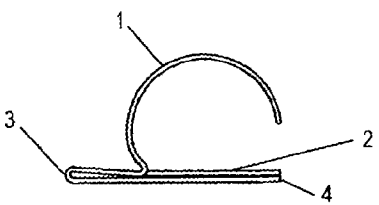
FIG. 2: Illustrates the side view of the one piece formed design Plectrum Clip after molding.
Figure 3:
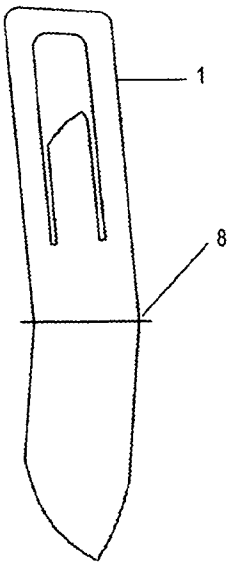
FIG. 3: Illustrates the flat unbent view one piece formed design Plectrum Clip before the material is bent into shape.
Figure 4:
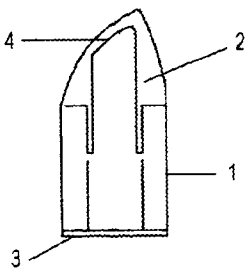
FIG. 4: Illustrates the top view one piece formed design Plectrum Clip after Molding.
Figure 5:
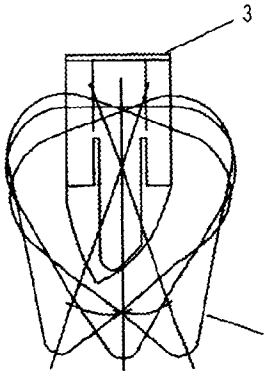
FIG. 5: Illustrates the top view one piece formed design Plectrum Clip after molding with pick inserted.
Figure 6:
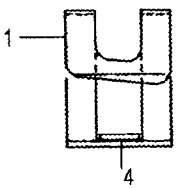
FIG. 6: Illustrates the front view one piece formed design Plectrum Clip after Molding.
Figure 11:
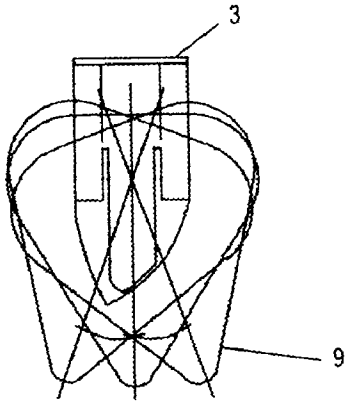
FIG. 11: Illustrates the top view of the Alternate one piece design Plectrum Clip after molding with pick inserted.
Figure 12:
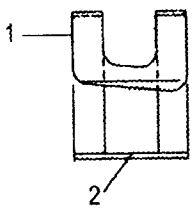
FIG. 12: Illustrates the front view of the Alternate one piece design Plectrum Clip after molding.
Figure 9:
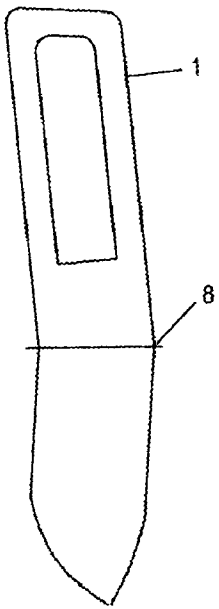
FIG. 9: Illustrates the flat unbent view of the Alternate one piece design Plectrum Clip before the material is bent into shape.
Figure 10:
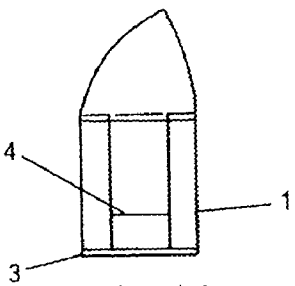
FIG. 10: Illustrates the top view of the Alternate one piece design Plectrum Clip after molding.
Figure 7:
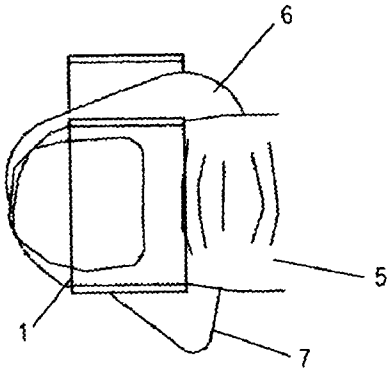
FIG. 7: Illustrates the bottom view of the Alternate one piece design completed assembly where the thumb, pick and Plectrum Clip are in relationship to one another.
Figure 8:
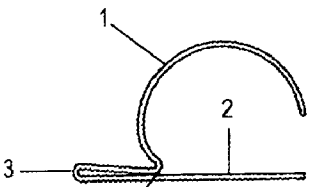
FIG. 8: Illustrates the side view of the Alternate one piece design Plectrum Clip after molding.
Figure 13:
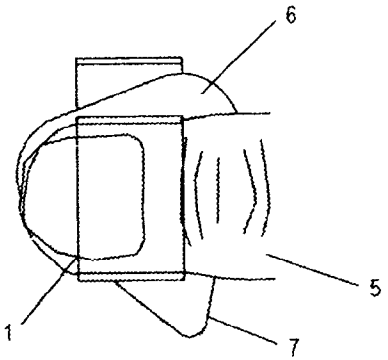
FIG. 13: Illustrates the bottom view of the two piece formed design with completed assembly where the thumb, pick and Plectrum Clip are in relationship to one another.
Figure 14:
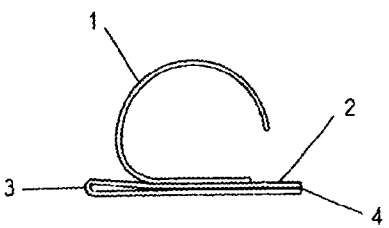
FIG. 14: Illustrates the side view of the two piece formed design Plectrum Clip with the two parts connected.
Figure 15:
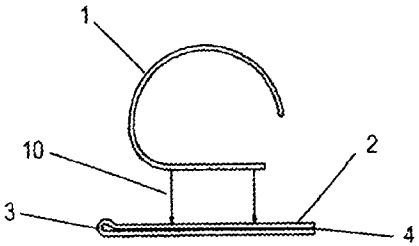
FIG. 15: Illustrates the side view of the two piece formed design Plectrum Clip with two parts of the two part design separated.
Figure 16:
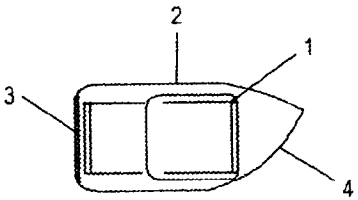
FIG. 16: Illustrates the top view of the two piece formed design Plectrum Clip with the two parts connected.

FIGS. 1 thru 6 Illustrate the first embodiment of the invention (one piece formed design). Thumb 5 is inserted into the looping thumb retainer 1. The Clip 2 provides clamping force to the pick where opening 4 is the area the butt of the pick 6 is inserted. Clip fold 3 joins the clip opening 4 thru a bend at clip fold 3 and urges the clipping parts in engagement for holding a pick 6, while a pick protrusion 7 extends outwardly for use in plucking a string of a stringed musical instrument. Bend line 8 illustrates where the clip fold 3 will be after flat material is bent into shape. Pick rotation 9 is an outcome of the pick 6 being arrangeable by the user of the invention.

FIGS. 7 thru 12 Illustrate the second embodiment of the invention (alternate one piece design). Thumb 5 is inserted into the looping thumb retainer 1. The Clip 2 provides clamping force to the pick where opening 4 is the area the butt of the pick 6 is inserted. Clip fold 3 joins the clip opening 4 thru a bend at clip fold 3 and urges the clipping parts in engagement for holding a pick 6, while a pick protrusion 7 extends outwardly for use in plucking a string of a stringed musical instrument. Send line 8 illustrates where the clip fold 3 will be after flat material is bent into shape. Pick rotation 9 is an outcome of the pick 6 being arrangeable by the user of the invention.

Figure 17:
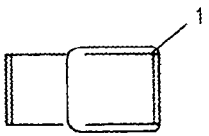
FIG. 17: Illustrates the top view of the two piece formed design molded plastic base of the Plectrum Clip.
Figure 18:
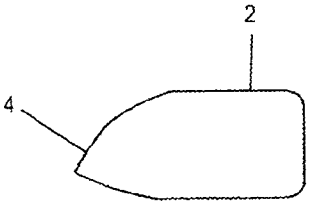
FIG. 18: Illustrates the top view of the metal clip of the two part design Plectrum Clip.
Figure 19:
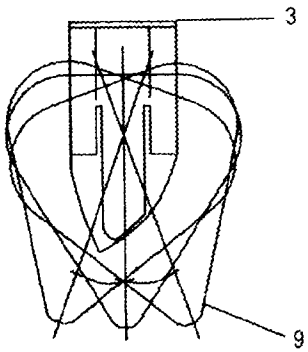
FIG. 19: Illustrates the top view of the two piece design with a pick inserted in the Plectrum Clip.
Figure 20:
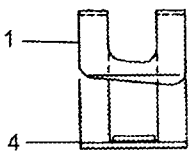
FIG. 20: Illustrates the front view of the two piece design fully assembled Plectrum Clip.

FIGS. 13 thru 20 Illustrate the third embodiment of the invention (two piece formed design). Thumb 5 is inserted into the looping thumb retainer 1. The Clip 2 provides clamping force to the pick where opening 4 is the area the butt of the pick 6 is inserted. Clip fold 3 joins the clip opening 4 thru a bend at clip fold 3 and urges the clipping parts in engagement for holding a pick 6, while a pick protrusion 7 extends outwardly for use in plucking a string of a stringed musical instrument. Pick rotation 9 is an outcome of the pick 6 being arrangeable by the user of the invention. FIGS. 17 and 18 illustrate the looping thumb retainer 1 and clip 2 independently in this two piece design. Bonding 10 is required to bring the independent pieces to together.

MATERIALS

Music Instrument Plectrum Clip that will have but not limited to: Spring metal, Polymers (celluliod, nylon, delrin, acetal, ultern, lexam, and carbon nylon), elastomer (natural and synthetic), Wood, and any combination of these materials. These materials may have various textures and colors.

Design of the Plectrum Clip are in three different sizes, (small medium and large) and 2 different designs. Depending on material, cut or mold material to the clip design. In the case of metal, bend and texture the pre-cut pattern into shape, temper the metal to achieve correct rigidness, fine sand to remove imperfections, coat the clip with elastomer, or anodize it for corrosive protection. In the case of Polymer, injection molds the Plectrum Clip design and fine sand to remove imperfections. For wood materials, us a C and C machine to carve the pick clip design, fine sand to remove imperfections, stain and seal wood for protection.

The metal, polymer, or wood is the base material while anodizing, using elastomer, or sealant protects it. The texture is applied to add grip to the surface of the pick clip. To finish the pick clip would take the following: Metal, anodizing to apply different colors for the material, or elastomer of different colors, Polymer would be created of different colors with either a glossy or matte finish, or elastomer of different colors applied, wood would be stained various colors and sealed, or sealed and painted various colors.

The application of the Pick Clip allows the user to maintain control to the pick while using various different playing styles such as: Finger picking, Two handed tapping, chicken picking, standard picking etc. . . keeping it firmly fixed to the thumb.

Plectrum Clip will have but are not limited to: Spring steel, Elastomer, Polymer, wood, and any combination of these materials. Additional materials are defined, but not limited to, the following:

Spring Steel: any metal or allow that can be tempered to have the proper amount of rigidness.

Polymer: any plastic composite including but not limited to: celluliod, nylon, delrin, Elastomer: any rubber composite including but not limited to: Acetal, Ultern, Lexam, and carbon nylon.

- Natural Rubber (NR)
- Synthetic Polyisoprene (IR)
- Butyl rubber (copolymer of isobutylene and isoprene, IIR)
  - Halogenated butyl rubbers (Chloro Butyl Rubber: CIIR; Bromo Butyl Rubber: BIIR)
- Polybutadiene (BR)
- Styrene-butadiene Rubber (copolymer of polystyrene and polybutadiene, SBR)
- Nitrile Rubber (copolymer of polybutadiene and acrylonitrile, NBR), also called Buna N rubbers
  - Hydrogenated Nitrile Rubbers (HNBR) Therban and Zetpol
- Chloroprene Rubber (CR), polychloroprene, Neoprene, Baypren etc
  - EPM (ethylene propylene rubber, a copolymer of ethylene and propylene) and EPDM rubber (ethylene propylene diene rubber, a terpolymer of ethylene, propylene and a diene-component)
  - Epichlorohydrin rubber (ECO)
  - Polyacrylic rubber (ACM, ABR)
  - Silicone rubber (SI, Q, VMQ)
  - Fluorosilicone Rubber (FVMQ)
  - Fluoroelastomers (FKM, and FEPM) Viton, Tecnoflon, Fluorel, Aflas and Dai-El
  - Perfluoroelastomers (FFKM) Tecnoflon PFR, Kalrez, Chemraz, Perlast
  - Polyether Block Amides (PEBA)
  - Chlorosulfonated Polyethylene (CSM), (Hypalon)
  - Ethylene-vinyl acetate (EVA)
  - Thermoplastic elastomers (TPE), for example Elastron, etc.
  - Thermoplastic Vulcanizates (TPV), for example Santoprene TPV
  - Thermoplastic Polyurethane (TPU)
  - Thermoplastic Olefins (TPO)
  - The proteins resilin and elastin
  - Polysulfide Rubber Wood: any wood and combination wood composite including but not limited to:

Section 1.01 Softwoods (Conifers)

- Araucaria
  - Hoop Pine (Aus.) *Araucaria cunninghamii*
  - Parana Pine (Brazil) *Araucaria angustifolia*
  - Pehuén or Chile Pine *Araucaria araucana*
- Cedar (*Cedrus*); also applied to a number of woods from trees in the Cypress family mainly in North America, see Red Cedar, Whitecedar and Yellow-Cedar in Softwoods, and to woods from some relatives of the mahogany, see Spanish-cedar and Australian Red Cedar in Hardwoods.
- Cypress (*Chamaecyparis, Cupressus, Taxodium*)
  - Arizona Cypress (*Cupressus arizonica*)
  - Bald Cypress or Southern cypress (*Taxodium distichum*)
  - Hinoki Cypress (*Chamaecyparis obtusa*)
  - Lawson's Cypress (*Chamaecyparis lawsoniana*)
  - Mediterranean Cypress (*Cupressus sempervirens*)
- Rocky Mountain Douglas-fir (*Pseudotsuga menziesii* var. *glauca*)
- European Yew (*Taxus baccata*)
- Fir (*Abies*)
  - Balsam Fir (*Abies balsamea*)
  - Silver Fir (*Abies alba*)
  - Noble Fir (*Abies procera*)
  - Pacific Silver Fir (*Abies amabilis*)
- Hemlock (*Tsuga*)
  - Eastern Hemlock (*Tsuga canadensis*)
  - Mountain Hemlock (*Tsuga mertensiana*)
  - Western Hemlock (*Tsuga heterophylla*)
- Kauri (New Zealand) (*Agathis australis*)
- Kaya (*Torreya nucifera*)
- Larch (*Larix*)
  - European Larch (*Larix decidua*)
  - Japanese Larch (*Larix kaempferi*)
  - Tamarack Larch or Tamarack (*Larix laricina*)
  - Western Larch (*Larix occidentalis*)
- Pine (Pinus; Many woods are incorrectly called "Pine". See Araucaria and Douglas-fir above)
  - Corsican pine (*Pinus nigra*)
  - Jack Pine (*Pinus banksiana*)
  - Lodgepole Pine (*Pinus contorta subsp latifolia*)
  - Monterey Pine (*Pinus radiata*)
  - Ponderosa Pine (*Pinus ponderosa*)
  - Red Pine (N.Am.) (*Pinus resinosa*)
  - Scots Pine, Red pine (UK), Red deal (UK), Redwood (UK, obsolete) (*Pinus sylvestris*)
  - White Pine in (N.Am.), Yellow or Weymouth pine (UK, obsolete)
    - Eastern White Pine (*Pinus strobus*)
    - Western White Pine (*Pinus monticola*)
    - Sugar Pine (*Pinus lambertiana*)
  - Southern Yellow pine (US)
    - Loblolly Pine (*Pinus taeda*)
    - Longleaf Pine (*Pinus palustris*)
    - Pitch Pine (*Pinus rigida*)
    - Shortleaf Pine (*Pinus echinata*)
- "Redcedar"
  - Eastern Redcedar, (*Juniperus virginiana*)
  - Western redcedar (*Thuja plicata*)
- Redwood (*Sequoia sempervirens*)

Rimu (New Zealand) (*Dacrydium cupressinum*)
Spruce (*Picea*)
Norway Spruce (*Picea abies*)
Black Spruce (*Picea mariana*)
Red Spruce (*Picea rubens*)
Sitka Spruce (*Picea sitchensis*)
White Spruce (*Picea alauca*)
Sugi (*Cryptomeria japonica*)
"Whitecedar"
Northern Whitecedar (*Thuja occidentalis*)
Southern Whitecedar (*Chamaecyparis thyoides*)
"Yellow-cedar" (Nootka Cypress *Callitropsis nootkatensis*, formerly *Chamaecyparis nootkatensis*)
Section 1.02 [edit] Hardwoods (angiosperms)
Acacia
Afzelia (*Afzelia*)
Agba yun (*Synsepalum duloificum*)
Albizia (*Albizia*)
Alder (*Alnus*)
Black alder (*Alnus alutinosa*)
Red alder (*Alnus rubra*)
Applewood or wild apple (*Malus*)
Arbutus (*Arbutus*)
Ash (*Fraxinus*)
Black ash (*Fraxinus nigra*)
Blue ash (*Fraxinus quadranaulata*)
Common ash (*Fraxinus excelsior*)
Green ash (*Fraxinus pennsylvanica lanceolata*)
Oregon ash (*F. latifolia*)[1]
Pumpkin ash (*F. profunda*)[1]
White ash (*Fraxinus americana*)
Aspen (*Populus*)
Bigtooth aspen (*Populus arandidentata*)
European aspen (*Populus tremula*)
Quaking aspen (*Populus tremuloides*)
Australian Red Cedar (*Toona ciliata*)
Ayan (*Distemonanthus benthamianus*)
Balsa (*Ochroma pyramidale*)
Basswood
American basswood (*Tilia americana*)[1]
White basswood (*T. heterophylla*)[1]
Beech (*Fagus*)
European Beech (*Fagus sylvatica*)
American Beech (*Fagus arandifolia*)
Birch (*Betula*)
American birches
Gray birch (*Betula populifolia*)
River birch (*B. nigra*)
Paper birch (*Betula papyrifera*)
Sweet birch (*Betula lenta*)
Yellow birch (*B. alleahaniensis* syn *Betula lutea*)—most common birch wood sold in N.Am.
European birches, also Baltic birch (N.Am.)
Silver birch (*Betula pendula*)
White Birch (*Betula pubescens*)
Blackbean (*Castanospermum australe*)
Blackwood
Australian Blackwood also Tasmanian Blackwood (*Acacia melanoxylon*)
African Blackwood or Mpingo (*Dalbergia melanoxylon*)
Bocote (*Cordia alliodora*)
Boxelder (*Acer negundo*)
Boxwood or Box (*Buxus sempervirens*)
Brazilwood (*Caesalpinia echinata*)
Bubing a (*Guibourtia*)
Buckeye (*Aesculus*)
Common Horse-chestnut (*Aesculus hippocastanum*)
Ohio buckeye (*Aesculus glabra*)
Yellow Buckeye (*Aesculus flava* syn. *Aesculus octandra*)
Butternut (*Jualans cinerea*)
Carapa (or Andiroba, Carap, Crappo, Crabwood and Santa Maria) (*Carapa auianensis*).
Catalpa (*Catalpa*)
Cherry (*Prunus*)
Black cherry (*Prunus serotina*)
Red cherry (*Prunus pennsylvanica*)
Wild cherry (*Prunus avium*)
"Brazilian Cherry" Not a Cherry See Jatoba below
Chestnut (*Castanea dentata*)
Cape Chestnut (*Calodendrum capense*)
Coachwood (*Ceratopetalum apetalum*)
Cocobolo (*Dalbergia retusa*)
Corkwood (*Leitneria floridana*)
cottonwood
Balsam poplar (*Populus balsamifera*)
Eastern cottonwood (*Populus deltoides*)
Plains cottonwood (*Populus sargentii*)
Swamp cottonwood (*Populus heterophylla*)
Cucumbertree (*Magnolia acuminata*)
Dogwood (*Cornus* spp.)
Flowering dogwood (*Cornus florida*)
Pacific dogwood (*Cornus nuttallii*)
Ebony (*Diospyros*)
Andaman marble-wood (India) (*Diospyros kurzii*)
Ebène marbre (Mauritius, E. Africa) (*Diospyros melanida*)
Gabon ebony, Black ebony, African ebony (*Diospyros crassiflora*)
Elm
American elm (*Ulmus americana*)
English elm (*Ulmus procera*)
Rock elm (*Ulmus thomasii*)
Slippery elm (*Ulmus rubra*)
Wych elm (*Ulmus alabra*)
Eucalyptus (*Eucalyptus*)
Lyptus
Karri (W. Australia) (*Eucalyptus diversicolor*)
Mahogany eucalyptus, (New South Wales) (*Eucalyptus*)
Ironbark *Eucalyptus sideroxylon*
Jarrah or West Australian eucalyptus (*Eucalyptus marginata*)
Tasmanian oak or Mountain ash, (*Eucalyptus reanans Eucalyptus obliqua Eucalyptus deleaatensis*)
River Red Gum
Blue Gum *Eucalyptus saligna*
Greenheart (Guyana) (*Chlorocardium rodiei*)
Grenadilla (Mpingo) (*Dalbergia melanoxylon*)
Gum
Blackgum (*Nyssa sylvatica*)
Blue gum (*Eucalyptus globulus*)
Redgum or Sweetgurn (*Liquidambar styraciflua*)
Tupelo gum (*Nyssa aquatica*)
Hickory (*Carya*)
Mockernut hickory (*Carya alba*)
Pignut hickory (*Carya alabra*)
Shagbark hickory (*Carya ovata*)
Shellbark hickory (*Carya laciniosa*)
Hornbeam (*Carpinus species*)
Hophornbeam, Eastern (*Ostrya virginiana*)
Ipê or Poui (*Tabebuia*)
Iroko (*Milicia excelsa* syn *Chlorophora excelsa*)

Ironwood refers to the wood of many tree species noted for the hardness of their wood. Trees commonly known as ironwoods include:
- *Bangkirai*, also known as *Balau*.
- *Carpinus caroliniana*—also known as American hornbeam
- *Casuarina equisetifolia*—Common Ironwood from Australia
- *Choricbanaarpia subargentea*
- *Copaifera* spp.
- *Eusideroxylon zwageri*
- *Guajacum officinale* and *Guajacum sanctum*—Lignum vitae
- *Hopea odorata*
- "Ipe High in silica this wood makes a great decking material. Other common name "Brazilian Walnut"
- *Krugiodendron ferreum*—Black Ironwood
- *Lyonothamnus lyonii* (*L. floribundus*)—Catalina Ironwood
- *Mesua ferrea*—also known as Rose Chestnut or Ceylon Ironwood, from Thailand, Laos, Vietnam, Cambodia
- *Olea* spp.—various olive trees
- *Olneya tesota*—Desert Ironwood
- *Ostrya virginiana*—Hop hornbeam
- *Parrotia persica*—Persian Ironwood
- *Tabebuia serratifolia*—Yellow Lapacho Jacarandá, Brazilian rosewood (*Dalberaia nigra*)
Jatobá (*Hymenaea courbaril*)
Lacewood from the Sycamore (N.Am.) or Plane (UK) trees (*Platanus* species)
Laurel, California (*Umbellularia californica*)
Limba (*Terminalia superba*)
Lignum vitae (*Guaiacum officinale* and *Guaiacum sanctum*)
Locust
- Black locust or Yellow locust (*Robinia pseudacacia*)
- Honey locust (*Gleditsia triacanthos*)

Mahogany
Maple (*Acer*)
- Hard Maple (N.Am.)
  - Sugar maple (*Acer saccharum*)
  - Black maple (*Acer nigrum*)
- Soft Maple (N.Am.)
  - Manitoba maple (*Acer negundo*)
  - Red maple (*Acer rubrum*)
  - Silver maple (*Acer saccharinum*)
- European Maples
  - Sycamore maple (*Acer pseudoplatanus*)

Meranti (*Shorea* spp.)
Mpingo (Grenadilla) (*Dalbergia melanoxylon*)
Oak (*Quercus*)
- American White Oak includes wood from any of the following species of trees:
  - Bur oak (*Quercus macrocarpa*)
  - White oak (*Quercus alba*)
  - Post oak (*Quercus stellata*)
  - Swamp white oak (*Quercus bicolor*)
  - Southern live oak (*Quercus virginiana*)
  - Swamp chestnut oak (*Quercus michauxii*)
  - Chestnut oak (*Quercus prinus* or *Q. Montana*)
  - Chinkapin oak (*Quercus muhlenberaii*)
  - Canyon live oak (*Quercus chrysolepis*)
  - Overcup oak (*Quercus lyrata*)
- English oak, also French and Slovenian oak barrels (*Quercus robur* and sometimes *Quercus petraea*)
- Red oak includes wood from any of the following species of trees:
  - Red oak (*Quercus rubra*)
  - Black oak (*Quercus velutina*)
  - Laurel oak (*Quercus laurifolia*))
  - Southern red oak (*Quercus falcata*)
  - Water oak (*Quercus nigra*)
  - Willow oak {*Quercus phellos*)
  - Nuttall's oak (*Quercus texana* or *Q. nuttallii*)
  - Willow oak (*Quercus phellos*)
- "Tasmanian oak"; Not an oak see Eucalyptus above
- Australian "Silky oak"; Not an oak see Silky Oak below Obeche or Samba, Ayous, Arere, Wana, Abache (West Africa) (*Triplochiton scleroxylon*)
Okounné or "Gaboon" (*Aucoumea klaineana*)
Oregon Myrtle or California Bay Laurel (*Umbellularia californica*)
Pear (*Pyrus communis*)
Pernambuco is another name for Brazilwood (*Caesalpinia echinata*)
Poplar (Populus; in N.Am., wood sold as poplar is usually Yellow-poplar—see below)
- Balsam poplar (*Populus balsamifera*)
- Black poplar (*Populus nigra*)
- Hybrid poplar (*Populus×canadensis*)

Ramin
Red cedar (*Toona ciliata*)
Rosewood (*Dalberaia* spp.)
Sal (*Shorea robusta*)
Sandalwood (*Santalum*)
Sassafras (*Sassafras albidum*)
Sassafras (Australia) (*Atherosperma moschatum*)
Satinwood (Ceylon) (*Chloroxylon swietenia*)
Silky Oak (Grevillea robusta)—Sold as Lacewood in North America
Silver Wattle *Acacia dealbata*
Snakewood
Sourwood (*Oxydendrum arboreum*)
Spanish-cedar (*Cedrela odorata*)
American sycamore (*Platanus occidentalis*)
Teak (*Tectona Grandis*)
Walnut (*Jualans*)
- Black Walnut (*Jualans niara*)
- Persian Walnut (*Juglans regia*)
- Brazilian walnut; Not a walnut see Ipe above.

Willow (*Salix*)
- Black willow (*Salix niara*)
- Cricket-bat willow (*Salix alba* 'Coerulea')
- White willow (*Salix alba*)

Yellow-poplar (*Liriodendron tulipifera*)

Section 1.03 [edit] Hardwoods (monocotyledons)
- Bamboo (a number of species in Tribe: Bambuseae)
- Palmwood (*Cocos nucifera*) is 'new' wood source that is increasingly being used as an ecologically-sound alternative to endangered hardwoods.

I claim:

1. A Musical Instrument Plectrum Clip, for securing a plectrum to a user's thumb, comprising:
- a sheet strip of a first material having a first end, a fold line, and a second end, the first end has a tab-like portion shorter than second end;
- a thumb holding part, comprising the loop of material that wraps around the thumb holding opening;
- a plectrum securing part formed of the first end and second ends of the sheet material strip folded about the fold line comprising a clamping relation between the second end of the material strip through the fold, with respect to a length of the first end of the material strip and the tab portion, and a securing portion between the thumb holding part and the plectrum securing part;

where the strip panels pinch a plectrum placed within the plectrum opening and the plectrum is oriented in the width direction of the thumb, the point of the plectrum placed opposite the fold, and the plectrum opening having a depth wider than the thumb width for holding the full length of a flat plectrum, except the picking point, and where the pinching strip panels allow a range of angular positions of the plectrum picking point from a position inclined toward the base of the thumb to a position inclined toward the end of the thumb.

2. The musical instrument plectrum clip of claim 1, where the first end of the strip formed into two shape portions by a cut into the strip around the first end to leave a narrow strip on three sides forming a loop portion and a tab-like portion within the loop, the loop portion forming the thumb-holding part and comprising the same material as the plectrum securing part.

3. The musical instrument plectrum clip of claim 1, where the loop of the thumb holding part is a polymer ring, comprising a part looping around the thumb and a flat mounting part, where the mounting part of loop is adhered to the plectrum securing part.

4. A method of making a Musical Instrument Plectrum Clip from sheet metal comprising:

cutting out a pattern into a strip of sheet material that includes a first end, a fold line and a second strip, the first strip further comprising a cut into the strip around the first end to leave a narrow strip on three sides forming a loop portion and a tab-like portion within the loop;

folding first and second strips into a pinching relation about the fold line, the space between the strips for holding a plectrum; and bending the ring portion into an arc back toward the bend line to make an opening for partially encircling a user's thumb, while the tab remains against the first strip in a pinching relation to form a receptacle for holding a plectrum or is removed to allow contact between the pick and thumb.

5. A method of manufacturing a Musical Instrument Plectrum Clip from a single piece Polymer, comprising:

form by molding a plectrum gripping part of a facing first and second strip of polymer material wider then the depth of the thumb, joined at one end in a pinching relation, and open at the other end for receiving a plectrum therein; and a Thumb-holding part molded into a thumb ring having an arcuate part for wrapping partially around the thumb, located at the plectrum gripping part in an area central to the depth of the plectrum receptacle so that a plectrum may be retained at a user's preferred depth deeper than the width of the thumb and at a user's preferred angle.

* * * * *